US006894240B2

(12) United States Patent
Komoto et al.

(10) Patent No.: US 6,894,240 B2
(45) Date of Patent: May 17, 2005

(54) PUSH SWITCH

(75) Inventors: Keiko Komoto, Okayama (JP); Yasunori Yanai, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 69 days.

(21) Appl. No.: 10/760,571

(22) Filed: Jan. 20, 2004

(65) Prior Publication Data

US 2004/0182688 A1 Sep. 23, 2004

(30) Foreign Application Priority Data

Jan. 30, 2003 (JP) ..... 2003-021818

(51) Int. Cl.[7] ..... H01H 13/14
(52) U.S. Cl. ..... 200/512; 200/406; 200/516
(58) Field of Search ..... 200/5 A, 406, 200/512–517, 341, 345

(56) References Cited

U.S. PATENT DOCUMENTS 4,418,257 A * 11/1983 Muller et al. ..... 200/517
5,899,617 A * 5/1999 Tsai ..... 400/490
6,552,288 B2 * 4/2003 Ono ..... 200/512
6,664,491 B2 * 12/2003 Yanai et al. ..... 200/516

FOREIGN PATENT DOCUMENTS

| | | |
|---|---|---|
| JP | 06-056929 | 8/1994 |
| JP | 10-092260 | 4/1998 |
| JP | 11-265634 | 9/1999 |

* cited by examiner

*Primary Examiner*—Michael A. Friedhofer
(74) *Attorney, Agent, or Firm*—RatnerPrestia

(57) ABSTRACT

A push switch includes a switch contact section including first and second contacts, and an elastic element for connecting the first and second contacts by pushing the first contact. The elastic element includes a columnar portion for connecting the first and second contacts by pushing the first contact, a hollow conical portion extending from a junction positioned at an end of the columnar portion, the conical portion having a truncated conical shape, and a thick portion provided at a whole circumstance of the junction.

7 Claims, 9 Drawing Sheets

PUSH SWITCH

FIELD OF THE INVENTION

The present invention relates to a push switch used in input operation sections of electronic apparatuses.

BACKGROUND OF THE INVENTION

Push switches used in input operation sections of electronic apparatuses are demanded to have small sizes and excellent durability, and are further desired to operate by an operating force predetermined to prevent malfunction due to accidental touch on the operation sections and to generate a proper click feel. Therefore, the push switches often includes elastic members made of rubber and having conical shapes.

A conventional push switch disclosed in Japanese Patent Laid-Open Publication No.10-92260 and Japanese Patent Laid-Open Publication No.11-265634 will be explained. FIG. 7 is a front sectional view of the conventional push switch, and FIG. 8 is a perspective exploded view of the switch. A contact substrate 1 includes a peripheral fixed contact 2, a central fixed contact 3, and connection terminals 2A and 3A connected with the contacts 2 and 3, respectively. A movable contact 4 of elastic metal thin plate is provided over the contact substrate 1 and includes a ring 4A and a tongue 4B. The ring 4A is mounted on the peripheral fixed contact 2. The tongue 4B projects toward the center of the ring from an inner periphery of the ring and is folded upward. The contact substrate 1 and the movable contact element 4 provides a switch contact section.

A rubber elastic element 5 is placed on the movable contact element 4. The elastic element 5 includes a central columnar portion 5A, a conical portion 5B, a ring portion 5C, and a protrusion 5D. The conical portion 5B having a predetermined thickness flares linearly downward obliquely from a junction 5E at the outer circumference of the columnar portion 5A. The ring portion 5C has a lower end mounted on the annular portion 4A of the movable contact element 4. The protrusion 5D having a diameter smaller than that of the columnar portion 5A faces the tongue 4B of the movable contact element 4 provided at the lower end of the columnar portion 5A. The conical portion 5B is hollow and has a truncated cone shape.

A push button 6 made of rigid resin as an operation section is located on the top of the columnar portion 5A of the elastic element 5. A case 7 is fixed by a pawl 1A of the contact substrate 1 so as to surround the periphery of the conical portion 5B. The button 6 is supported by a guide groove 7A in the case 7 so as to be movable up and down.

FIG. 9 is a front sectional view of the conventional push switch which is operating.

In this push switch, when the top of the push button 6 is pressed by a pressing force F, the columnar portion 5A and protrusion 5D of the elastic element 5 are pushed downward with the button 6. Then, as shown in FIG. 9, the conical portion 5B elastically deforms outward by a predetermined stroke with a click feel, and the leading end of the protrusion 5D pushes the tongue 4B of the movable contact 4 to have the contact 4 contact the central fixed contact 3. This contacting allows the peripheral fixed contact 2 to be connected with the central fixed contact 3, and makes the contacts 2 and 3 to output a signal transmitted to a circuit of the electronic apparatus through the connection terminals 2A and 3A.

Then, when the pressing force applied to the button 6, i.e., the columnar portion 5A of the elastic element 5 is released, the conical portion 5B restores its original truncated conical shape with its own elastic restoring force, so that the button 6 is pushed upward with the columnar portion 5A. Simultaneously to this, the tongue 4B of the movable contact element 4 restores upward to its original shape, and is departed from the central fixed contact 3.

In the conventional push switch, after tens of thousand times of operations at a temperature extremely lower or higher than a room temperature, cracks may be generated in the junction 5E linked to the conical portion 5B linearly flaring from the outer circumference of the columnar portion 5A of the elastic element 5.

If the rubber forming the elastic element 5 has a hardness reduced by having the composition of the rubber vary, a durability of the rubber against deterioration of the rubber is improved, as disclosed in Japanese Utility Model Laid-Open Publication No.6-56929.

If the rubber forming the elastic element 5 has a small hardness, however, the conical portion 5B starts deforming with a small force, and thus, an operating force of the push switch becomes smaller.

SUMMARY OF THE INVENTION

A push switch includes a switch contact section including first and second contacts, and an elastic element for connecting the first and second contacts by pushing the first contact. The elastic element includes a columnar portion for connecting the first and second contacts by pushing the first contact, a hollow conical portion extending from a junction positioned at an end of the columnar portion, the conical portion having a truncated conical shape, and a thick portion provided at a whole circumstance of the junction. In the thick portion, a distance from an intersection where an extension line an outer circumference of the columnar portion and an extension line of an outer circumference of the conical portion cross to an intersection where an outer circumference of the junction and a bisector of a crossing angle formed by the extension line of the outer circumference of the columnar portion and the extension line of the outer circumference of the conical portion ranges from 0.08 times to 0.14 times of a thickness of the conical portion.

This push switch operates with a click feel at a predetermined force, and operates stably by a great number of times even at a severe temperature apart from a room temperature.

DESCRIPTION OF THE PREFERRED EMBODIMENT

Figure 1:
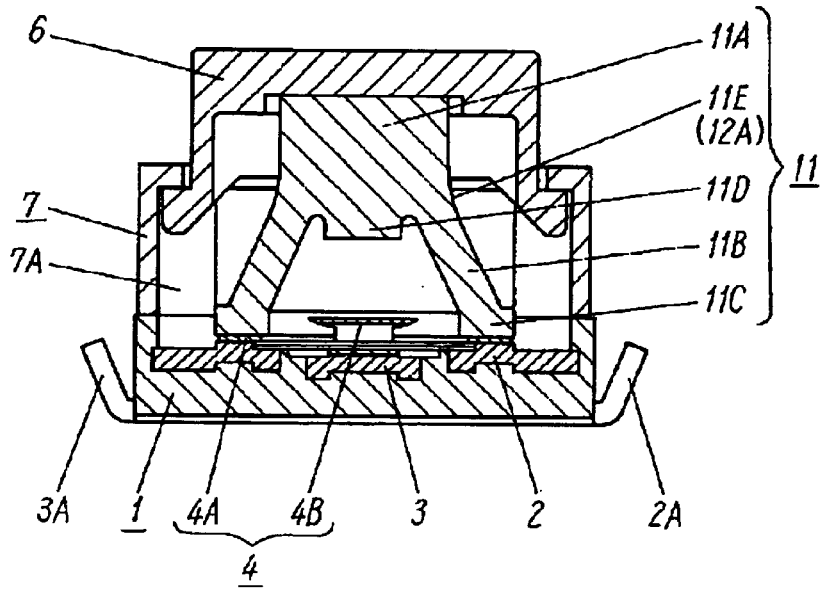
FIG. 1 is a front sectional view of a push switch according to an exemplary embodiment of the present invention.

FIG. 1 is a front sectional view of a push switch according to an exemplary embodiment of the present invention. The switch has a basic structure and overall dimensions identical to those of a conventional push switch shown in FIG. 7. Therefore, the same parts as of the conventional switch are denoted by the same reference numerals, and detailed description is omitted.

A contact substrate 1 includes a peripheral fixed contact 2, a central fixed contact 3, and connection terminals 2A and 3A connected to the contacts 2 and 3, respectively. A movable contact element 4 made of elastic thin metal plate includes a ring 4A and a tongue 4B and is put on a contact substrate 1, thus providing a switch contact section. An elastic element 11 made of rubber is put on the contact substrate 1. The elastic element 11 includes a columnar portion 11A, a hollow conical portion 11B, a ring portion 11C at the lower end of the conical portion 11B, and a protrusion 11D provided at the lower end of the columnar portion 11A. The conical portion 11B has a truncated conical shape flaring linearly downward obliquely from a junction 11E at the outer circumference of the columnar portion 1A. The protrusion 11D has a diameter smaller than that of the columnar portion 11A. The protrusion 11D faces the tongue 4B of the movable contact 4. The conical portion 11B is hollow and has a truncated conical shape.

This push switch, similarly to the conventional push switch, is pressed, and the protrusion 11D pushes the tongue 4B to have the tongue 4B contact the central fixed contact 3.

Figure 7:
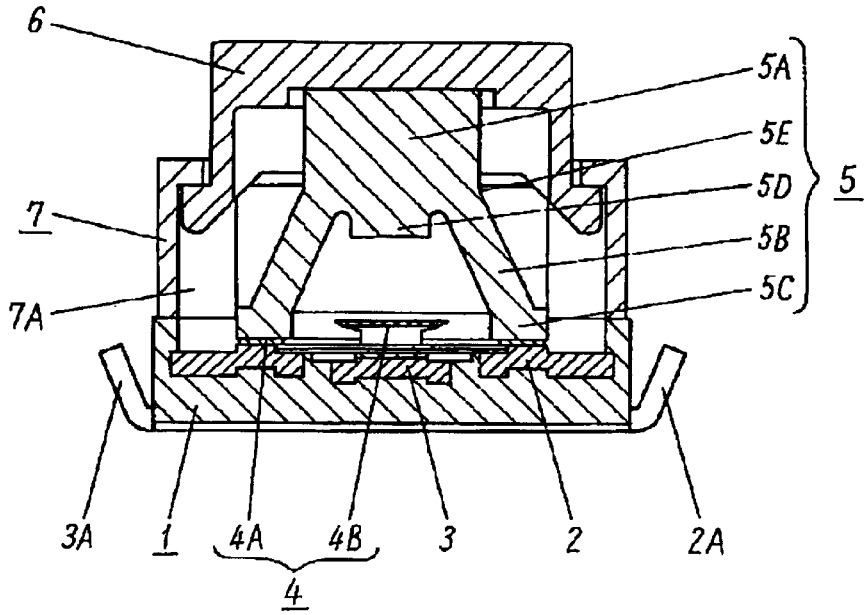
Fig. 7 Prior Art
FIG. 7 is a front sectional view of the conventional push switch.
Figure 8:
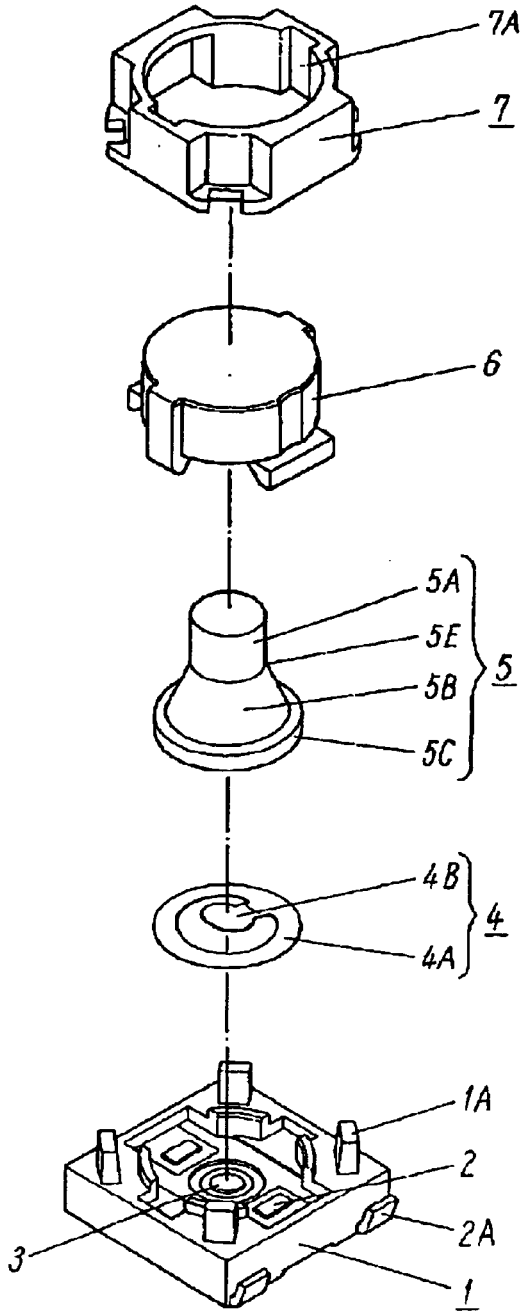
Fig. 8 Prior Art
FIG. 8 is a perspective exploded view of the conventional push switch.
Figure 9:
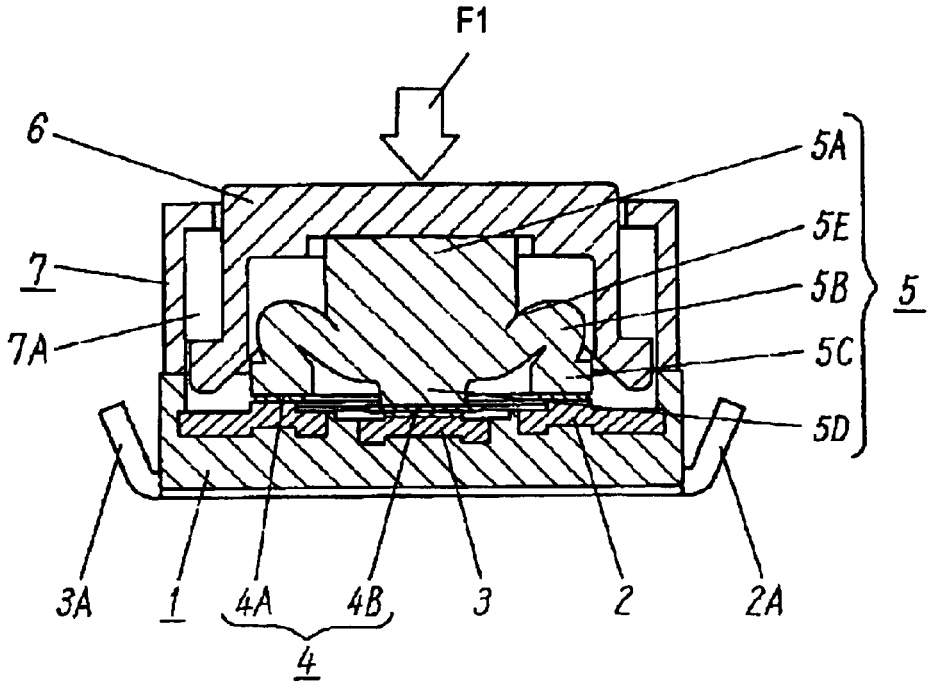
Fig. 9 Prior Art
FIG. 9 is a front sectional view of the conventional push switch.

A push button 6 made of rigid resin is placed on the top of the columnar portion 11A of the elastic element 11 as an operation section. This push button 6, similarly to the conventional push switch shown in FIG. 7, is supported by a guide groove 7A in a case 7 fixed on the contact substrate 1 so as to be movable up and down.

Figure 2:
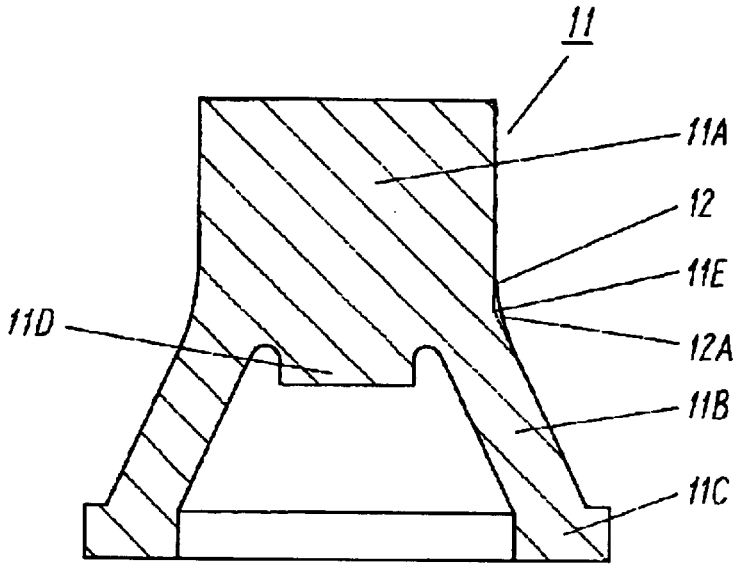
FIG. 2 is an enlarged sectional view of an elastic element of the push switch of the embodiment.

FIG. 2 is an enlarged sectional view of the elastic element 11. The elastic element 11 further includes a thick portion 12A surrounded by an arc 12 having a predetermined radius, as shown in FIG. 2, along the entire periphery of the junction 11E, the border between the conical portion 11B and columnar portion 11A. The hardness of the rubber forming the elastic element 11 is smaller than that of the elastic element 5 of the conventional push switch.

Figure 3:
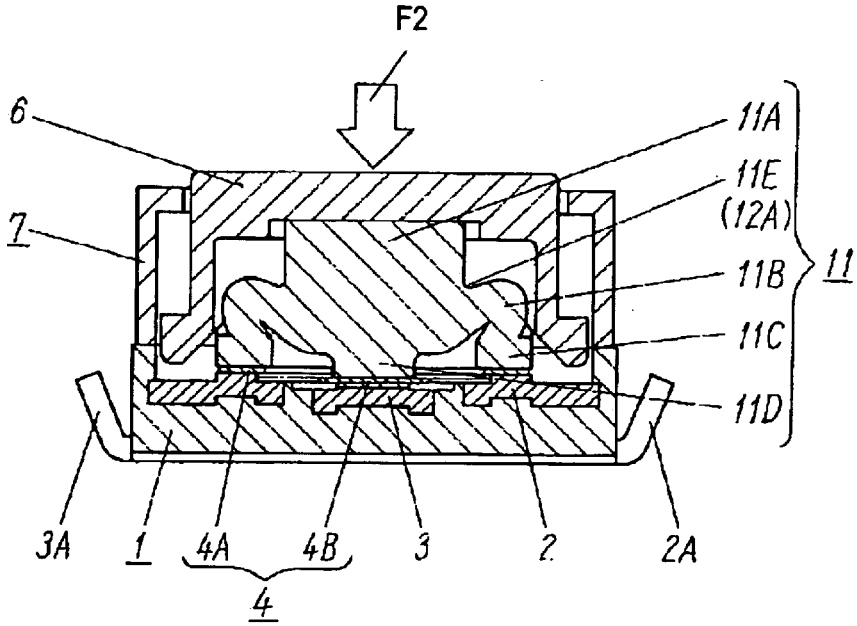
FIG. 3 is a front sectional view of the push switch of the embodiment.

FIG. 3 is a front sectional view of the push switch of the embodiment during an pressing operation. In the push switch of the embodiment having the elastic element 11, when the top of the push button 6 is pressed by a pressing force F2, the columnar portion 11A and protrusion 11D of the elastic element 11 are pushed downward with the push button 6. Then, as shown in FIG. 3, the conical portion 11B elastically deforms by a predetermined stroke outward with a click feel. The protrusion 11D pushes the tongue 4B of the movable contact element 4 to have the tongue 4B contact the central fixed contact 3, and the peripheral fixed contact 2 is connected to the central fixed contact 3, thus transmitting a signal to a circuit of an electronic apparatus through the connection terminals 2A and 3A.

Figure 4A:
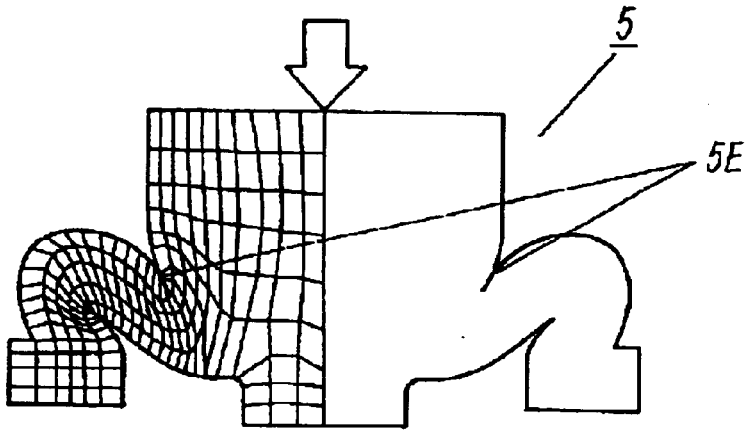
Fig. 4A Prior Art
FIG. 4A shows a distribution of a stress during an operation of pressing an elastic element of a conventional push switch.
Figure 4B:
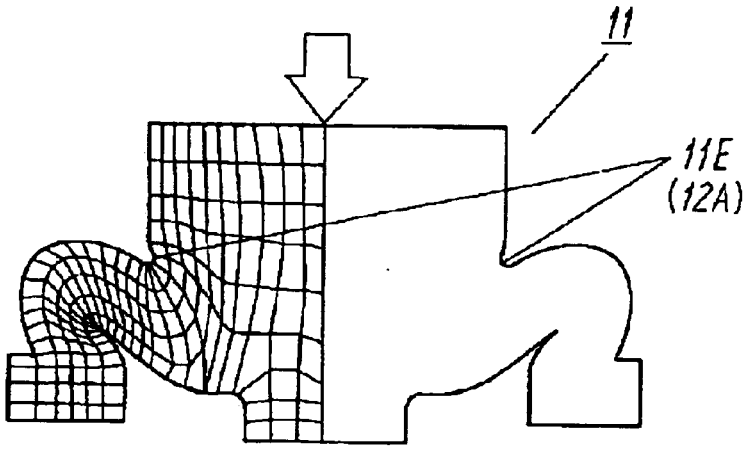
FIG. 4B shows a distribution of a stress during an operation of pressing the elastic element of the push switch of the embodiment.

FIG. 4A shows a distribution of a stress during a pressing operation applied to the conventional elastic element 5. FIG. 4B shows a distribution of a stress during the pressing operation applied to the elastic element 11 of the embodiment. In the elastic element 5, a stress concentrates at a portion which extremely deforms as shown by a mesh near the junction 5E. By contrast, in the elastic element 11 of the embodiment having the thick portion 12A at the junction 11E, a mesh deforms moderately near the junction 11E, and the stress is alleviated more than the conventional elastic element 5.

Results of measuring durability of the elastic element 11 having the junction 11E including the thick portion 12A of various sizes made of rubber materials having various hardnesses.

Figure 5A:
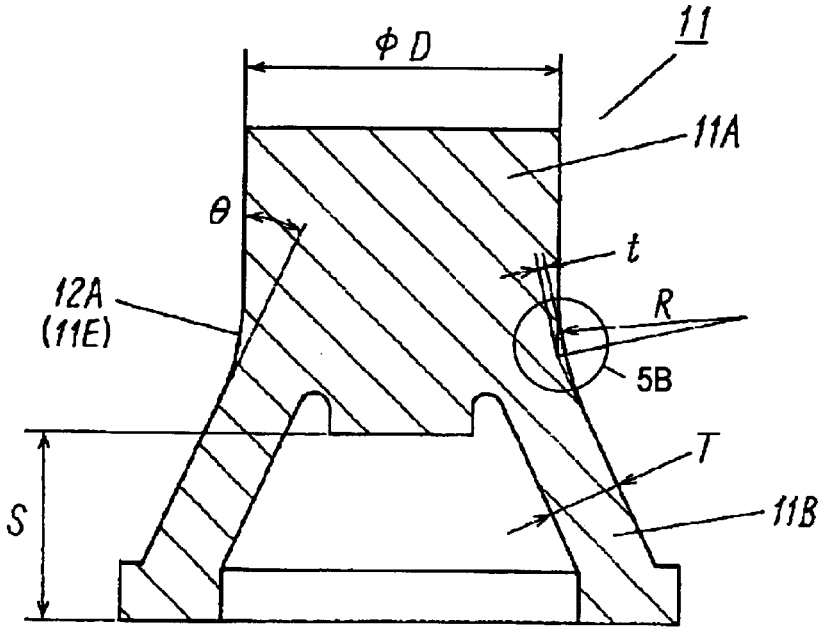
FIG. 5A shows dimensions of the elastic element of the push switch of the embodiment.

FIG. 5A shows dimensions of the elastic element 11 used for the measurement. The elastic element 11 is made of silicone rubber of type A durometer hardness of HA75 as measured in JIS K6253 durometer hardness test specified in JIS K 6249 (hereinafter called JIS hardness HA 75). A diameter D of the columnar portion 11A is 2.2 mm. The conical portion 11B flares downward obliquely from the outer periphery of the columnar portion 11A by an angle of $\theta=25°$, has a wall thickness of T=0.45 mm and a stroke S of 1.3 mm.

The elastic element 11 having the thick portion 12A of various radiuses R of curvature and the maximum thickness t, as shown in FIG. 5A, was tested at a temperature of 70° C. by deforming the conical portion 11B of the push switch with a click feel. Table 1 shows operating forces, click feel, and a number of times of operation of the elastic element 11. Ten samples for each of eight radiuses were prepared, and the operation force is an average of respective operation forces the ten samples for each radius.

Figure 5B:
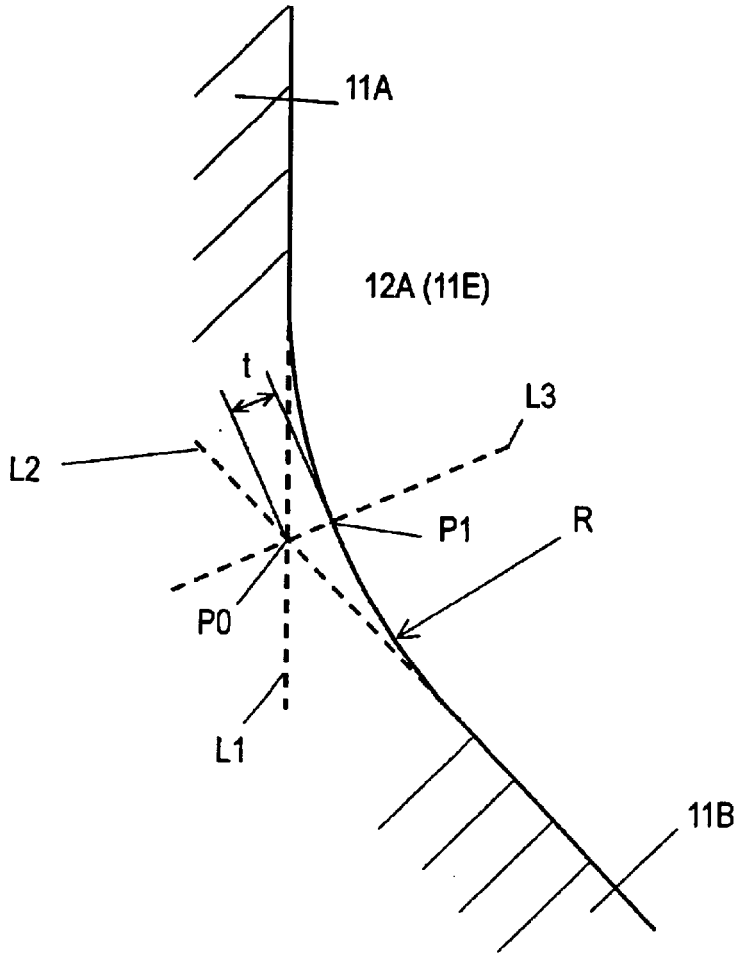
FIG. 5B is a partially enlarged view of the elastic element shown in FIG. 5A.

FIG. 5B is a partially enlarged view of the portion 5B of the elastic element 11 shown in FIG. 5A. As shown in FIG. 5B, the maximum thickness "t" of the thick portion 12A is defined as follows. In the thick portion 12A of the radius R of curvature, a bisector L3 of an angle formed by an extension line L1 of an outer side of the columnar portion 11A and an extension line L2 of an outer side of the conical portion 11B crossing at an intersection P0 is defined. The distance from the intersection P0 to the intersection P1 where the bisector L3 and an outer circumference of the thick portion 12A cross is defined as the maximum thickness "t". Table 1 also shows the ratio t/T of the thickness "t" to a wall thickness "T" (=0.45 mm) of the conical portion 11B. The thick portion 12A is provided around the entire circumstance of the junction 11E, and therefore, the intersections P0 and P1 are actually intersecting lines.

TABLE 1

| Radius R of Curvature (mm) | Maximum Thickness t (mm) | t/T | Operation Force (N) | Click Feel | Durability (Number of Times) |
|---|---|---|---|---|---|
| 0.0 | 0.000 | 0.000 | 3.0 | A | 30,000–50,000 |
| 1.0 | 0.024 | 0.053 | 3.2 | A | 50,000–150,000 |
| 1.5 | 0.037 | 0.082 | 3.4 | A | >130,000 |
| 2.0 | 0.049 | 0.109 | 2.5 | A | >200,000 |
| 2.5 | 0.061 | 0.136 | 3.6 | A | >200,000 |
| 3.0 | 0.073 | 0.162 | 3.8 | B | >200,000 |

TABLE 1-continued

| Radius R of Curvature (mm) | Maximum Thickness t (mm) | t/T | Operation Force (N) | Click Feel | Durability (Number of Times) |
|---|---|---|---|---|---|
| 4.0 | 0.097 | 0.216 | 4.0 | C | >200,000 |
| 5.0 | 0.121 | 0.269 | 4.2 | D | >200,000 |

The classification "A" for the click feel denotes the clearest and most excellent click feel. The classifications "B" and "C" denote a weak click feel. The classification "D" denotes substantially no click feel.

As shown in Table 1, according to an increase of the radius R of curvature of the thick portion 12A, the durability of the elastic element 11 is improved, but the operating force of the push switch increases, and the click feel becomes weak gradually. According to Table 1, in the elastic element 11 having the thick portion 12A of the radius R of curvature ranging from 1.5 mm to 2.5 mm provides the durability more than 100,000 times, a clear click feel, and the operating force larger than that of the elastic element without the thick portion 12A by 10% to 20%.

The radius R of curvature ranging from 1.5 mm to 2.5 mm provides the ratio, t/T, ranging from 0.082 to 0.136.

That is, in order to obtain the durability exceeding 100,000 times and the clear click feel, the radius R of curvature of the thick portion 12A is determined so that the maximum thickness t of the thick portion 12A ranges from 0.08 to 0.15 times of the wall thickness of the conical portion 11B.

In this conditions, however, the operating force of the push switch is large. Hence, elastic elements 11 made of silicone rubber materials having various hardnesses and including the thick portion 12A having a radius R of curvature of 2 mm, which is the median of the conditions, were tested at a temperature of 70° C. to measure an operating force and durability shown in Table 2. Ten samples for each hardness were prepared, and the operation force shown is an average of respective operation forces of the ten samples

TABLE 2

| JIS Hardness HA | Operating Force (N) | Click Feel | Durability (Number of Times) |
|---|---|---|---|
| 75 | 3.5 | A | >200.000 |
| 70 | 3.0 | A | >200.000 |
| 65 | 2.6 | A | >200.000 |

The classification "A of the click feel denotes the clearest and the most excellent click feel.

As shown in Table 2, the elastic element 11 of silicone rubber of JIS hardness HA 70 having the thick portion 12 of the radius R of curvature of 2 mm operates by the same operating force as the elastic element 11 of silicone rubber of JIS hardness HA 75 without the thick portion 12, and generates the click feel similar to that of the elastic element of JIS hardness HA 75, and an enhanced and stabilized durability.

The junction 11E between a linear portion of the side surface of the conical portion 11B and the outer circumference of the columnar portion 11A is chamfered to form a thick portion having the thickness t on the bisector, from the side view, of the angle is 0.08 times to 0.14 times of the thickness T of the conical portion 11B. The dimensional range of the elastic element 11 expected to provide such effect is estimated from experiments conducted for the elastic elements 11 of similar shape and dimension. The estimated ranges are shown as follows: the diameter D of columnar portion 11A ranges from 2 mm to 5 mm; an inclination angle θ of the conical portion 11B ranges from 20° to 40°; the thickness T of the conical portion 11B ranges from 0.3 mm to 0.6 mm; and the stroke S ranging from 0.5 mm to 2.5 mm.

In this case, the junction 11E of the elastic element 11 has the thick portion 12A having an arc section on its side. Even if the side of the thick portion 12A is linear, the substantially same effect as the thick portion 12A having the same maximum thickness t is obtained.

Thus, the thick portion 12A at the junction 11E at the border between the outer circumference of the columnar portion 11A of the elastic element 11 and the conical portion 11B flaring linearly allows the stress concentrating in this area to be reduced. The thick portion 12A increases the operating force for manipulating the columnar portion 11A, allows the hardness of the rubber for the elastic element 11 to be small, and improves the durability of the element 11. Therefore, even if being used at a temperature extremely depart from the room temperature, the push switch operates stably more than 100,000 times.

In the above explanation, the columnar part 11A of the elastic element 11 is pressed with the push button 6 supported by the case 7 to have the button 6 movable up and down. This structure allows the columnar portion 11A of the elastic element 11 to be pushed down stably and not to be inclined during the pressing operation. As a result, the stress generated in the elastic element 11 is distributed uniformly around the columnar portion 11A and does not concentrates in a specific direction, so that the number of times of operation until occurrence of crack in the elastic element 11 can be extended.

If a hinged operation button is used in an electronic apparatus to press the button stably, the push button 6 may be omitted, and the top of the columnar portion 11A of the elastic element 11 may be directly pushed by the operation button of the electronic apparatus.

Figure 6:
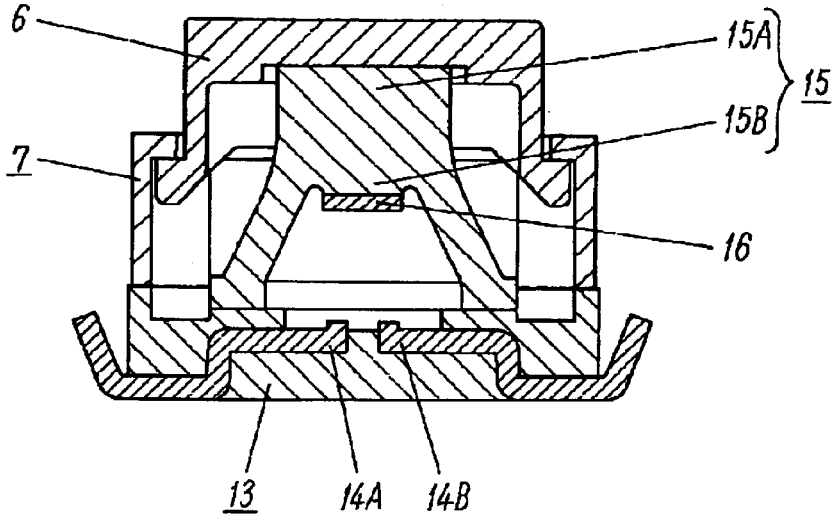
FIG. 6 is a front sectional view of another push switch according to the embodiment.

FIG. 6 is a front sectional view of another push switch of the embodiment. In the switch contact section of the push switch of the embodiment, the protrusion 11D of the elastic element 11 pushes the tongue 4B of the movable contact 4 onto the contact substrate 1, and the tongue 4B contacts and departs from the central fixed contact 3. The switch contact section may include, as shown in FIG. 6, a conductive portion 16 provided at a leading end of a protrusion 15B at the lower end of a columnar portion 15A of an elastic element 15 and fixed contacts 14A and 14B provided independently on a contact substrate 13. This push switch includes the switch contact section having a simple structure and operates stably.

What is claimed is:

1. A push switch comprising:

a switch contact section including first and second contacts; and an elastic element including a columnar portion for connecting the first and second contacts by pushing the first contact, a hollow conical portion extending from a junction positioned at an end of the columnar portion, the conical portion having a truncated conical shape, and a thick portion provided at a whole circumstance of the junction, wherein, in the thick portion, a distance from an intersection where an extension line of an outer circumference of the columnar portion and an extension line of an outer circumference of the conical portion cross to an intersection where an outer circumference of the junction and a bisector of a crossing angle formed by the extension line of the outer circumference of the columnar portion and the extension line of the outer circumference of the conical portion ranges from 0.08 times to 0.14 times of a thickness of the conical portion.

2. The push switch of claim 1, wherein the elastic element further includes a protrusion provided at a side of the columnar portion towards the conical portion, for pushing the first contact.

3. The push switch of claim 2, further comprising a conductive portion provided on the protrusion and operating as the first contact.

4. The push switch of claim 1, wherein the outer circumference of the thick portion has an arc shape having a center on the bisector, the arc shape being tangential to both the outer circumstance of the conical portion and the outer circumstance of the columnar portion.

5. The push switch of claim 1, further comprising a push button mounted on a side of the columnar portion opposite to the conical portion, the push button being movable along the conical portion.

6. The push switch of claim 5, wherein the switch contact section further includes a substrate for supporting the second contact, said push switch further comprising a case fixed on the substrate, the case supporting the push button movably.

7. The push switch of claim 1, further comprising a conductive portion provided on the protrusion and operating as the first contact.

* * * * *